US009852719B2

(12) United States Patent
Bragg

(10) Patent No.: US 9,852,719 B2
(45) Date of Patent: Dec. 26, 2017

(54) STRINGED INSTRUMENT

(71) Applicant: Madtown Music, LLC, Buckhead, GA (US)

(72) Inventor: Anthony Bragg, Buckhead, GA (US)

(73) Assignee: Madtown Music, LLC, Buckhead, GA (US)

( * ) Notice: Subject to any disclaimer, the term of this patent is extended or adjusted under 35 U.S.C. 154(b) by 0 days.

(21) Appl. No.: 15/403,545

(22) Filed: Jan. 11, 2017

(65) Prior Publication Data

US 2017/0200434 A1 Jul. 13, 2017

Related U.S. Application Data

(60) Provisional application No. 62/277,460, filed on Jan. 11, 2016.

(51) Int. Cl.
*G10D 1/08* (2006.01)
*G10D 3/06* (2006.01)

(52) U.S. Cl.
CPC ..... *G10D 1/085* (2013.01); *G10D 3/06* (2013.01)

(58) Field of Classification Search
CPC ..... G10D 3/06
See application file for complete search history.

(56) References Cited

U.S. PATENT DOCUMENTS 5,567,894 A 10/1996 Shiomi
5,965,831 A * 10/1999 McCabe ..... G10D 3/146 84/297 R
7,586,029 B2 9/2009 Peavey et al.
2008/0156168 A1 7/2008 Luttwak

FOREIGN PATENT DOCUMENTS

JP 63031097 Y2 8/1988
JP 5140096 B2 2/2013

OTHER PUBLICATIONS

PCT Search Report and Written Opinion for PCT/US2017/013007, dated Apr. 25, 2017, 11 pages.

* cited by examiner

*Primary Examiner* — Kimberly Lockett
(74) *Attorney, Agent, or Firm* — Waller Lansden Dortch & Davis, LLP; Blake M. Bernard

(57) ABSTRACT

A stringed instrument having a body including a back surface, a top head portion, and a treble-side. A cutaway can be defined in the body adjacent the top head portion on the treble side, the cutaway defining a cutaway edge. A cutout can be defined in the back surface, the cutout extending from the top head portion along at least a portion of the cutaway edge, the cutout defining a cutout surface. A neck can extend from the body, a portion of the neck disposed on a front side of the top head portion. A neck plate can be disposed on a back side of the top head portion, at least a portion of the neck plate positioned on the cutout surface, wherein the neck plate includes a plate cross section that corresponds to a cross section of the cutout at a location proximate the top head portion.

20 Claims, 8 Drawing Sheets

STRINGED INSTRUMENT

CROSS-REFERENCES TO RELATED APPLICATIONS

This application is a non-provisional of U.S. Patent Application Ser. No. 62/277,460 filed Jan. 11, 2016 entitled STRINGED INSTRUMENT which is herein incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to stringed instruments. In particular, the present disclosure relates to stringed instruments having a neck and a body that are secured together with mechanical fasteners.

Stringed instruments have been used for thousands of years. In particular, stringed instruments having a neck that supports the strings and a body, such as the body of a guitar, bass, violin, cello, fiddle, banjo, mandolin, etc., have been used by people around the world. These instruments have proven to be highly versatile and have been fundamental for the creation and composition of music in many different genres, including classical, rock, jazz, country, and the like.

Stringed instruments have been modified over the years. These changes have allowed instruments to create new sounds, genres, and styles of music. For instance, the incorporation of electronic components was one of the most significant innovations to stringed instruments in the 20th century. The sound from electronic stringed instruments can be electronically amplified, allowing musicians to play at greater volumes and to larger audiences. Electronic stringed instruments are also capable of replicating virtually any type of sound, making electronic stringed instruments even more versatile than their conventional counterparts.

Some styles of stringed instruments, including electric guitars and basses, have been developed with a body and a neck that are separably coupled with bolts or other mechanical fasteners. Furthermore, some designs, known as "bolt-on neck" designs, include a neck plate that is placed between the bolts that connect the body to the neck and the body itself. Neck plates can provide a more structurally sound fit between the body and the neck of the instrument and can help protect the body from damage by distributing and dissipating forces applied to the body from the heads of the bolts as the body and the neck are coupled together via the bolts. Additionally, the sound of a musical instrument can vary depending on the material, size, thickness, and shape of a neck plate.

Despite innovations in the shape and size of stringed instruments, it still remains difficult or impossible for some to play certain notes on stringed instruments. In particular, it remains difficult or impossible for some to play the upper register of stringed instruments. This is because the body, neck, and/or neck plates of instruments can block the hand and wrist from reaching points on the strings on a front side of the neck that are necessary for playing the upper register.

Some have attempted to cutout portions of the body and/or neck to provide increased access for a fretting hand to reach the upper register. However, these modifications are difficult or impossible in bolt on neck instruments because the neck plate limits how deep or wide the cutout can be. Some have attempted to circumvent this problem by decreasing the size of the neck plate, but this can limit the structural, acoustic, and aesthetic qualities of the instrument. Others have also attempted to circumvent this problem by bolting the neck and body together without a neck plate, but this completely eliminates the benefits that are provided by a neck plate.

Accordingly, there remains a need for bolt on neck stringed instruments that provide increased access to the upper register without compromising the structural and/or acoustic properties of the instrument.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a stringed instrument including a body that includes a back surface, a top head portion, and a treble-side. A cutaway can be defined in the body adjacent the top head portion of the body on the treble-side of the body, the cutaway defining a cutaway edge. A cutout can be defined in the back surface of the body, the cutout extending from the top head portion of the body along at least a portion of the cutaway edge, the cutout defining a cutout surface. A neck can extend from the body, a portion of the neck disposed on a front side of the top head portion of the body. A neck plate can be disposed on a back side of the top head portion of the body, at least a portion of the neck plate positioned on the cutout surface, wherein the neck plate includes a plate cross section that corresponds to a cross section of the cutout at a location proximate the top head portion of the body.

Another aspect of the present disclosure is an instrument having a body that includes a back surface, a top head portion, and a treble-side horn. A recessed cutaway can be defined in the body between the top head portion and the treble-side horn, the recessed cutaway defining a cutaway edge extending from the top head portion of the body to the treble-side horn. A cutout can be defined in the back surface of the body, the cutout extending from the top head portion of the body along at least a portion of the cutaway edge, the cutout defining a cutout surface. A neck can extend from the body, a portion of the neck disposed on a front side of the top head portion of the body. A neck plate can be disposed on a back side of the top head portion of the body, at least a portion of the neck plate positioned on the cutout surface, wherein the portion of the neck plate positioned in the cutout is shaped to contour the cutout.

Another aspect of the present disclosure is an instrument having a body that includes a back surface, a top head portion, and a treble-side horn. A recessed cutaway can be defined in the body between the top head portion and the treble-side horn, the recessed cutaway defining a cutaway edge extending from the top head portion of the body to the treble-side horn. A cutout can be defined in the back surface of the body, the cutout extending from the top head portion of the body along at least a portion of the cutaway edge, the cutout defining a cutout surface. A neck can extend from the body, a portion of the neck disposed on a front side of the top head portion of the body. A neck plate can be disposed on a back side of the top head portion of the body, at least a portion of the neck plate positioned on the cutout surface. A plurality of bolts can extend through the neck plate and the body and into the neck to separably couple the neck plate, the body, and the neck together, wherein at least one of the plurality of bolts extends through the cutout surface of the cutout.

One objective of the present disclosure is to help provide access to higher frets on an upper register of the neck of a stringed instrument.

Another objective of the present disclosure is to help provide the structural, acoustic, and aesthetic benefits of a neck plate for a stringed instrument.

Numerous other objects, advantages and features of the present disclosure will be readily apparent to those of skill in the art upon a review of the following drawings and description of a preferred embodiment.

DETAILED DESCRIPTION

Figure 1:
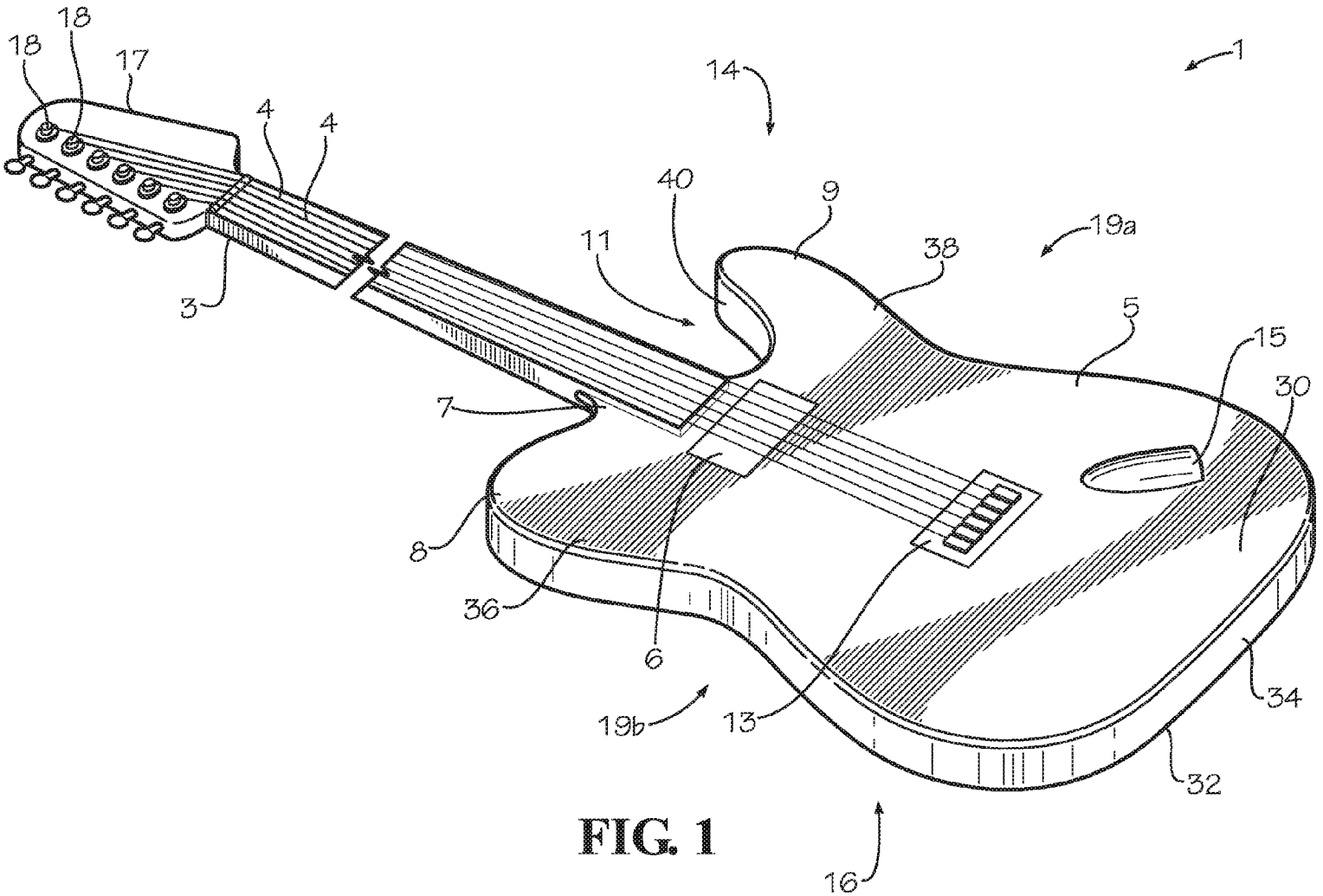
FIG. 1 is a perspective front view of a stringed instrument in accordance with an embodiment of the presently-disclosed subject matter.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

The presently-disclosed subject matter includes bolt on neck style stringed instruments. As used herein, the term "stringed instrument" generally refers to musical instruments that comprise a body and a neck that extends from the body, wherein the neck supports strings. Stringed instruments can include, without limitation, guitars, basses, violins, cellos, fiddles, banjos, mandolins, etc. The term "stringed instrument" is not limited to instruments that utilize strings to produce sound. For example, modern versions of stringed instruments can include sensors, pickups, amplifiers, or other electronic components along the length of the neck or body of the instrument that can produce electronic signals when the strings are plucked or strummed, the signals being converted into sound electronically. The term "stringed instrument" is inclusive of both conventional acoustic string instruments and electronic versions that may include other means for producing sound.

As used herein, the "treble side" of a stringed instrument or a body of the instrument is the side on which the fretting hand is positioned during normal operation of the guitar. In right-handed stringed instruments, the treble side of the stringed instrument can be the right side of the string instrument when viewed from the front. In left handed stringed instrument, the treble side of the stringed instrument can be the left side of the string instrument when viewed from the front. In still other embodiments, the "treble side" can denote the side of the stringed instrument corresponding to the higher pitched strings of the instrument, for instance the higher pitched G, B, and E, strings of a conventional six string guitar. References to a "bass side" denote the side of the guitar opposite the treble side.

Additionally, the term "bolt on neck" as used herein generally refers to a style of stringed instrument wherein the neck and body are coupled together with bolts. The term "bolt" as used herein generally refers to all of the coupling mechanisms that can be used in conjunction with bolt on neck instruments, including bolts, screws, nails, rivets, or other comparable mechanical fasteners.

Bolt on neck style instruments can further include a neck plate for joining the neck and body together. The neck plate can span the area where bolts are inserted into the back side of the body. Neck plates can be manufactured from suitable metals including but not limited to brass, bronze, chrome, aluminum, etc., as well as other suitable materials, such as, without limitation, polymers, composites, and plastics. Neck plates can distribute the forces that are applied by the bolts across a wider surface area of the body to help reduce damage to the body from the bolts. Neck plates also can provide beneficial acoustic properties. Neck plates are further desired by certain musicians for their aesthetic properties.

A specific embodiment of a stringed instrument 1 of the present disclosure will now be described. Unless otherwise stated, any reference herein to a front side or a back side of the embodiment is made from the perspective shown in FIG. 1. Thus, from the perspective shown in FIG. 1, the front side 14 corresponds to a side that faces towards the viewer, whereas a back side 16 corresponds to a side that faces away from the viewer. As such, in the right handed instrument 1 shown in FIG. 1, the treble-side 19*a* of the body is the side proximate the top of the page in FIG. 1, and the bass-side 19*b* of the body is the side proximate the bottom of the page in FIG. 1.

Looking to FIG. 1, an isometric front view of the embodied stringed instrument 1 is shown. The instrument 1 can include a body 5 and a neck 3 extending therefrom. The distal end of the neck 3 can include a headstock 17. A plurality of tuning pegs or tuning machines 18 can be provided on the headstock 17, wherein each tuning peg or machine 18 can be associated with a corresponding string 4 provided on the instrument 1. Stringed instruments can have varying numbers of strings, and thus varying numbers of corresponding tuning pegs 18. For instance, many stringed instruments such as guitars have 6 strings. Other stringed instruments can have 4, 5, 7, 8, etc. strings 4 and corresponding tuning pegs 18.

A bridge 13 can be positioned on the front side of the body 5 and includes anchor points and saddles for coupling each end of corresponding strings 4 to the body 5 of the instrument 1. To attach strings 4 to the body 5 of the instrument 1, the strings 4 can be coupled to the bridge 13 on the body 5. The bridge 13 provides a point for an end of each string 4 to attach, as well as a raised portion or saddle that each string 4 can pass over as they extend toward the headstock 17. The ends of the strings 4 that are not attached to the bridge 13 can each be wound around one of the tuning pegs or machines 18 that are provided on the headstock 17. In this manner, the strings 4 are suspended under tension between the raised portion of the bridge 13 and the distal end of the neck 3 so that they may vibrate freely when strummed or plucked to produce a sound. Additionally, each of the tuning pegs or machines 18 can be rotated to increase or decrease tension in the string to tune or adjust the pitch of the sound that is produced by each string 4.

The body 5 in some embodiments can include a pickup 6 disposed on the front surface of the body 5 at a position located under the strings 4. The pickup 6 can be a transducer that can sense vibrations from the strings 4 and convert the vibrations into electrical signals that can be amplified, recorded, or the like to produce sound electronically.

A jack 15 can also be provided on the front surface of the body 5 in some embodiments. The jack 15 can be an output jack that connects the instrument 1 to an amplifier or other electronic device. The jack 15 can also function as a power jack. In other embodiments a jack can be disposed on any surface on the instrument, including the back surface 32, front surface 30, or side peripheral edge or surface 34 of the body 5 of the instrument 1.

It will be understood that other embodiments may include different components on the front surface of the body. For instance, some embodiments are provided with two or more pickups. In yet other embodiments, one or more control knobs or switches can be provided on the front surface of the body, wherein the control knobs or switches can be manipulated to adjust the volume and other characteristics of the sound created by the instrument.

The end of the body 5 disposed towards the neck 3 (top end) includes a top head portion 7. Top head portion 7 can be flanked by an upper bass-side bout 36 and an upper treble side bout 38. A bout can be described as an outward bulge in the body 5 of the stringed instrument. In some embodiments, the upper bass-side bout 36 can include a bass-side horn 8 and the upper treble-side bout 38 can include a treble-side horn 9. The top head portion 7 generally refers to a central protruding portion of the top end of the body 5. A portion of the neck 3 can be coupled to a front side 30 of the body 5 at a location corresponding to the top head portion 7.

Figure 2:
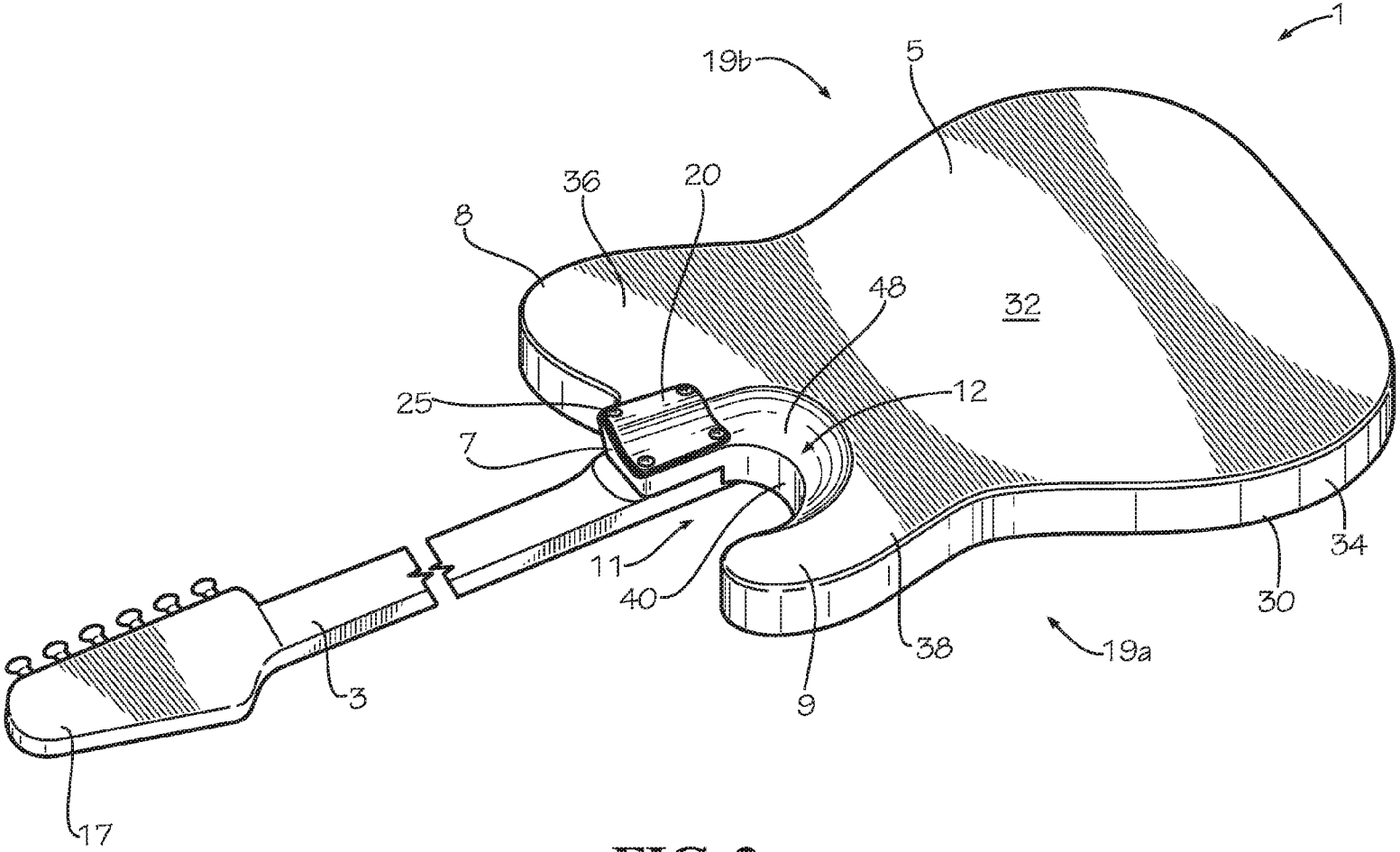
FIG. 2 is a perspective back view of the stringed instrument of FIG. 1.

Referring now to FIGS. 1-2, a cutaway 11 can generally be defined in the body adjacent the top head portion 7 on the treble side 19a of the body. The cutaway 11 can in some embodiments be defined in the upper treble-side bout 38 of the body 5 adjacent or proximate to the top head portion 7 of the body 5. In some embodiments including a treble side horn 9, the cutaway 11 can be defined between the top head portion 7 and the treble-side horn 9 of the body 5, such that the cutaway 11 can help define the treble-side horn 9. In such embodiments, the cutaway 11 can be recessed between the top head portion 7 and the treble-side horn of the body 5.

The cutaway 11 can define a cutaway edge 40. In some embodiments, the cutaway 11 is a generally curved recessed portion of the body 5 that defines a concave or c-shaped cutaway edge 40. In other embodiments, the cutaway 11 can have a variety of shapes, including but not limited to rectangular, triangular, trapezoidal, or other suitable shapes, which define corresponding cutaway edges. In still other embodiments, the cutaway 11 can be defined in a corner of the upper treble-side bout 38 such that the cutaway 11 forms a substantially L-shaped cutaway edge.

In some embodiments, stringed instrument 1 can include only the cutaway 11 on the treble side 19a of the body 5, such that the stringed instrument is a single cutaway embodiment. In other embodiments, a second cutaway can be defined adjacent the top head portion 7 of the body on the bass-side 19b of the body 5, such that the stringed instrument 1 is a double cutaway embodiment.

The cutaway 11 can facilitate some access to the upper register of the instrument 1, which corresponds to points on the strings 4 that are disposed towards the end of the neck 3 that is proximate to the top head portion 7 of the body 5 (proximate end of neck). For instance, to fret the upper register of an instrument, a musician presses on a string 4 so as to shorten the length of string that vibrates. To reach the upper register, a musician must therefore fret a string 4 at a location that is disposed towards the proximate end of the neck 3. This can require that the musician reach a portion of the neck 3 that is located near the top head portion 7 of the body 5, adjacent to the body 5, or over a front side 30 of the body 5.

When fretting the upper register, the musician reaches their hand around the neck 3 to reach the string 4. However, as the musician moves towards the upper register, the body 5 can block the hand and wrist from reaching the upper register. The cutaway 11 facilitates access to the upper register by increasing the space or room that the musician has to move their hand and wrist along the neck 3 of the instrument 1 towards the proximate end of the neck 3. However, even in conventional stringed instruments with cutaways, the size and thickness of the body 5 proximate the upper register can make it difficult or cumbersome for a user to reach or grasp the frets on the upper register to fret the upper register properly.

Referring now to FIGS. 2-6, a cutout 12 can be defined in a back surface 32 of the body 5, the cutout 12 extending from the top head portion 7 of the body 5 along at least a portion of the cutaway edge 40. The cutout 12 is defined by a portion of the body 5 that is recessed relative to the back surface 32 of the body 5 along at least a portion of the cutaway edge 40. The cutout 12 can define a cutout surface 48. Because the cutout 12 extends along the cutaway edge 40, the cutout 12 can have a profile or shape that generally conforms to the profile or shape of the cutaway 11. For instance, in some embodiments having a cutaway 11 with a semicircular shape, the cutout 12 defines a concave curved cut into the body 5 along the cutaway edge 40. In some embodiments, the cutout 12 can also have a generally semicircular shape or profile. In other embodiments, the cutout 12 can have a shape or profile conforming to cutaways of various shapes, including but not limited to rectangular, triangular, trapezoidal, or any other suitable shape.

In some embodiments the cutout 12 can extend along the entire cutaway edge 40, and in some embodiments having a treble-side horn 9, along the entire cutaway edge 40 between the top head portion 7 and the treble-side horn 9. In other embodiments the cutout 12 can extend from the top head portion 7 along only a portion of the cutaway edge 40, or to a point on the cutaway edge 40 that is between the top head portion 7 and the treble-side horn 9. For instance, in some embodiments having a generally semicircular cutaway 11, the cutout 12 can extend only to an apex of the semicircular cutaway 11 as opposed to extending completely to the tip of the treble-side horn 9.

In some embodiments, the cutout 12 can have a substantially continuous cross-section along the entire cutaway edge 40. In other embodiments, the cross-section of the cutout 12 can vary as the cutout extends along the cutaway edge 40. In some embodiments, the cutout 12 can converge or gradually decrease in size as the cutout 12 extends from the top head portion 7 of the body 5 along the cutaway edge 40. The cross section of the cutout 12 however can remain constant in the portion of the cutout 12 extending proximate the top head portion 7 of the body 5.

In some embodiments, the cutout 12 does not extend through the entire thickness 42 of the body 5. Accordingly, the cutout 12 can help increase access to the upper register beyond what is provided by the cutaway 11, as the user's fretting hand and wrist, and particularly the heel of the user's fretting hand, can be received in and the cutout 12 such that the user can more easily grasp the neck 3 and body 5 of the instrument 1 proximate the higher register of the instrument 1 to fret the higher register properly. Having the cutout 12 defined through only a portion of the thickness 42 of the body 5 can also allow a portion of the body 5 positioned between the cutout 12 and the neck 3 be used to separably couple or secure the body 5 to the neck 3 of the instrument 1. Such a configuration can provide structural integrity to the connection between the body 5 and the neck 3, as the neck 3 can be secured to the top head portion 7 of the body 5 with the top head portion 7 having a width that is substantially equal to the width of the neck 3.

The instrument 1 further includes a neck plate 20. The neck plate 20 is positioned on a back surface 32 of the body 5, and particularly on a back side of the top head portion 7 opposite from a location where the proximate end or proximate portion of the neck 3 contacts the front side 30 of the body 5 and top head portion 7. At least a portion of the neck plate 20 can be disposed or positioned on the cutout surface 48 of the cutout 12. The width of the neck plate 20, the width of the top head portion 7, and the width of the neck 3 in some embodiments can be substantially equal. In other embodiments, the width of the neck plate 20 can be slightly smaller than the width of the top head portion 7 of the body 5 and the width of the neck 3.

Figure 4:
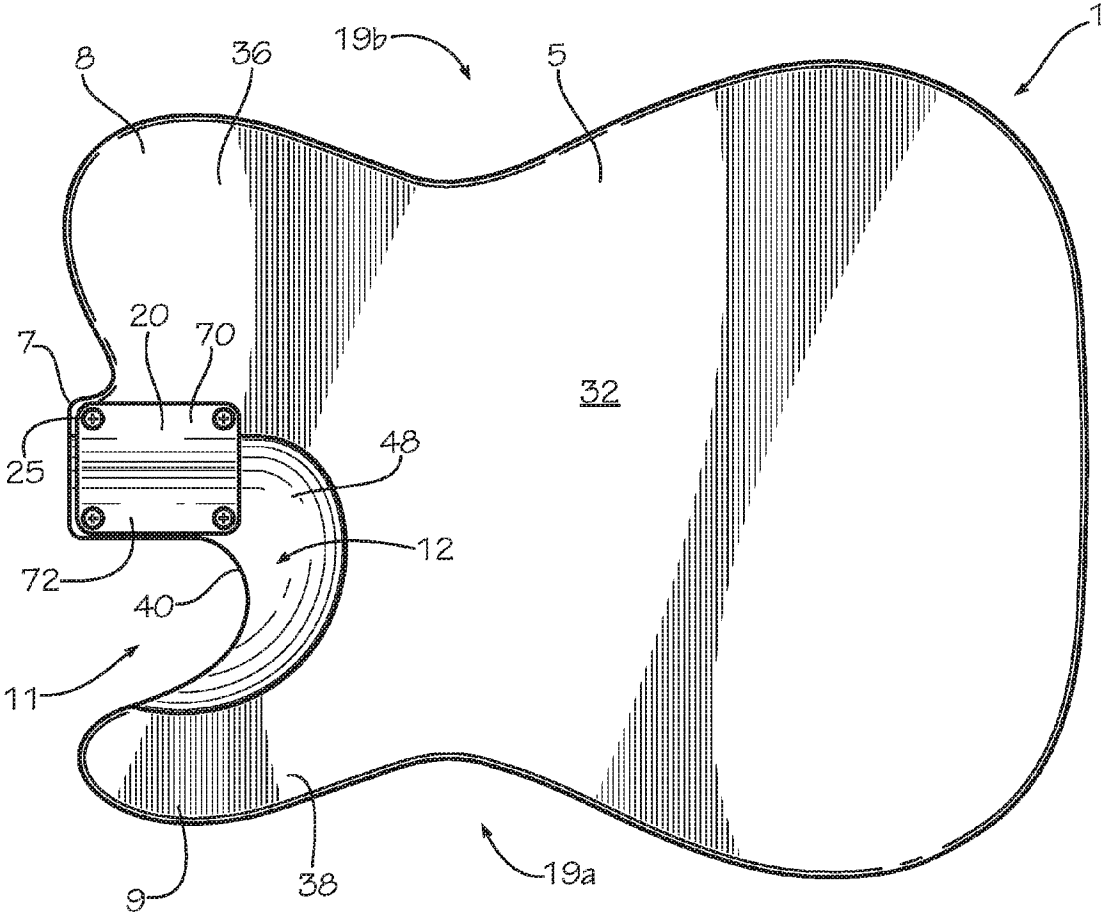
FIG. 4 is a back view of the stringed instrument of FIG. 3.
Figure 3:
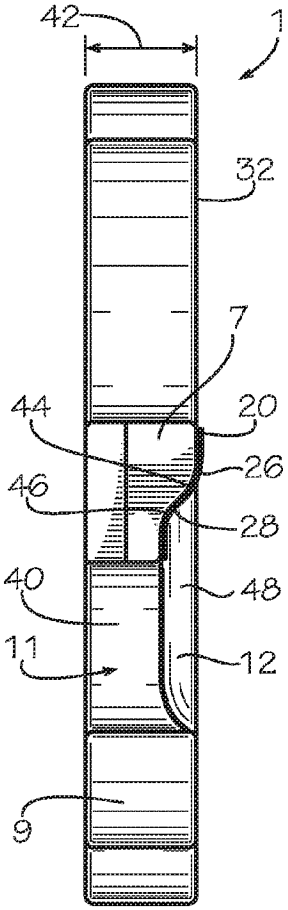
FIG. 3 is a top view of the stringed instrument of FIG. 1 with the neck removed.

Looking now to FIGS. 3 and 4, views are shown of the instrument 1 without a neck 3 mounted to the body 5. FIG. 3 shows that the neck plate 20 includes a contour or plate cross-section that corresponds to a cross section of the cutout 12 at a position proximate the top head portion 7 of the body 5. As such, when the neck plate 20 is positioned on a back surface 32 of the body 5 proximate the back side of the top head portion 7, the neck plate 20 can generally be shaped to contour the cutout surface 48 of the cutout 12. In this manner, the neck plate 20 on the instrument 1 can cover a portion of the back surface 32 of the body 5 including a portion of the cutout 12 extending through the top head portion 7 of the body.

Figure 9:
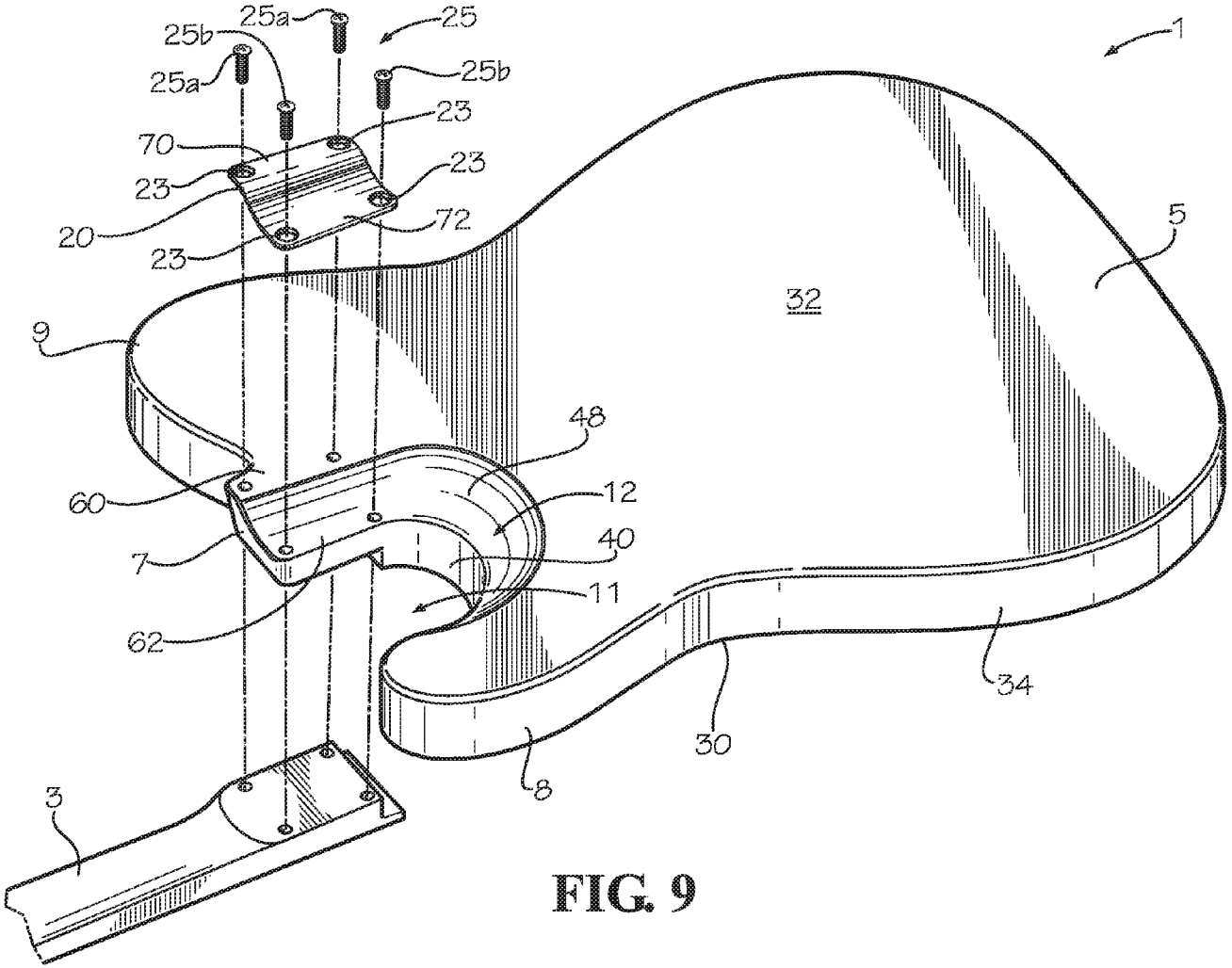
FIG. 9 is an exploded view of the stringed instrument of FIG. 1.

FIG. 9 shows an exploded view of the instrument 1 where the neck 3, body 5, and neck plate 20 are being separably mounted or coupled together with a plurality of bolts 25. The neck plate 20 is configured to be mounted to the top head potion 7 of the body 5 on the back surface 32 of the body 5 of the instrument 1. When the neck plate 20 is in this position, a portion of the neck plate 20 can be positioned in the cutout 12 and contact the cutout surface 48. The neck 3 is configured to be mounted to the top head portion 7 of the body 5 from a front side 30 of the body 5 of the instrument 1. The neck 3 is positioned such that the proximate end or proximate portion of the neck 3 is positioned against and contacts the top head portion 7 of the body 5 opposite the neck plate 20.

The neck plate 20 can include a plurality of through holes 23 that extend through the neck plate 20. Bolts 25 can be inserted into the through holes 23 on the neck plate 20, through the body 5, and into the proximate end of the neck 3. The plurality of bolts 25 can include at least a first bolt 25*a* and a second bolt 25*b*. The first bolt 25*a* can extend through the back surface 32 of the body 5 at a location proximate the cutout 12, and the second bolt 25*b* can extend through the cutout surface 48 of the cutout 12. As such, the neck plate 20 can be secured against the back surface 32 of the body 5 and the cutout surface 48 of the cutout 12 via bolts 25. In some embodiments, two or more bolts 25*a* can extend through the neck plate 20 and the back surface 32 of the body 5, and/or two or more bolts 25*b* can extend through the neck plate 20 and the cutout surface 48 of the cutout 12. As such, the neck plate 20 can include a back surface portion 70 disposed against the back surface 32 of the body 5 proximate the back side of the top head portion 7 of the body 5, and a cutout portion 72 disposed against the cutout surface 48 of the cutout 12.

Figure 5:
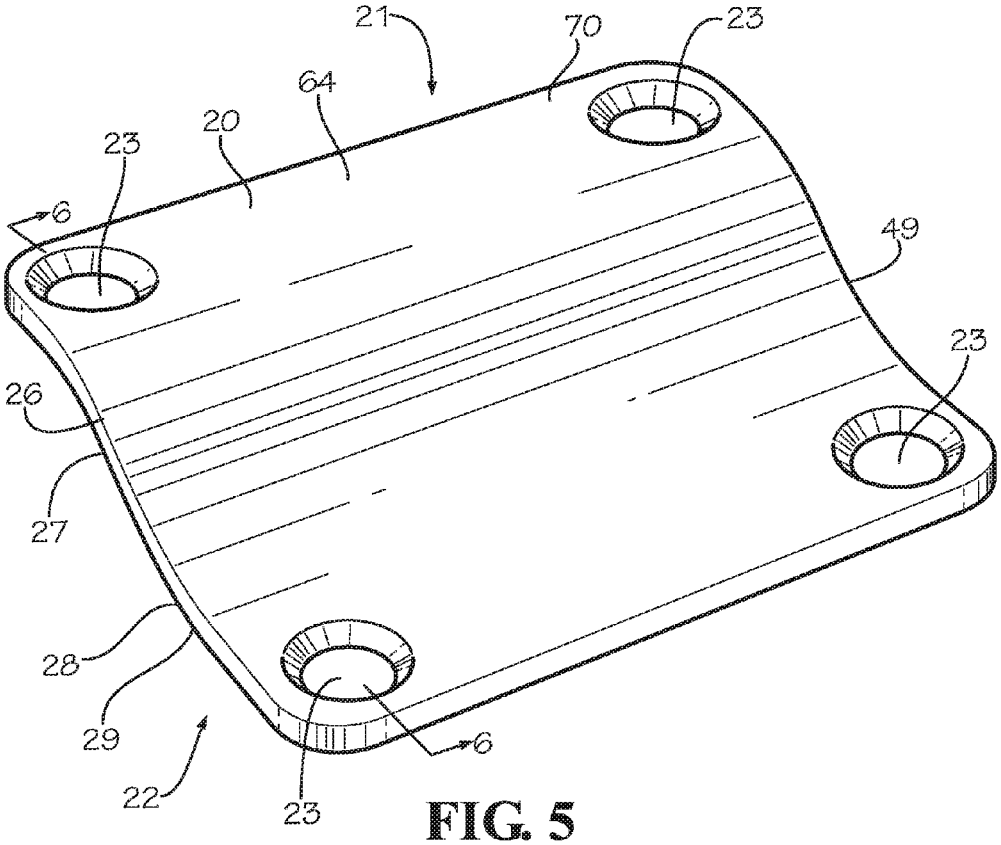
FIG. 5 is a detailed perspective view of a neck plate of the stringed instrument of FIG. 1.

In some embodiments, as shown in FIG. 5, the through holes 23 in the neck plate 20 can have tapered edges such that the bolts 25 can be countersunk into the neck plate 20 when bolts 25 secure the neck 3, the body 5, and the neck plate 20 together such that heads of the bolts 25 can generally be flush with the top side 21 of the neck plate 20. Such a configuration can help allow a user's fret hand to slide smoothly over the neck plate 20 without interference from the bolts 25 as the user's hand is received in the cutout 12.

Figure 10:
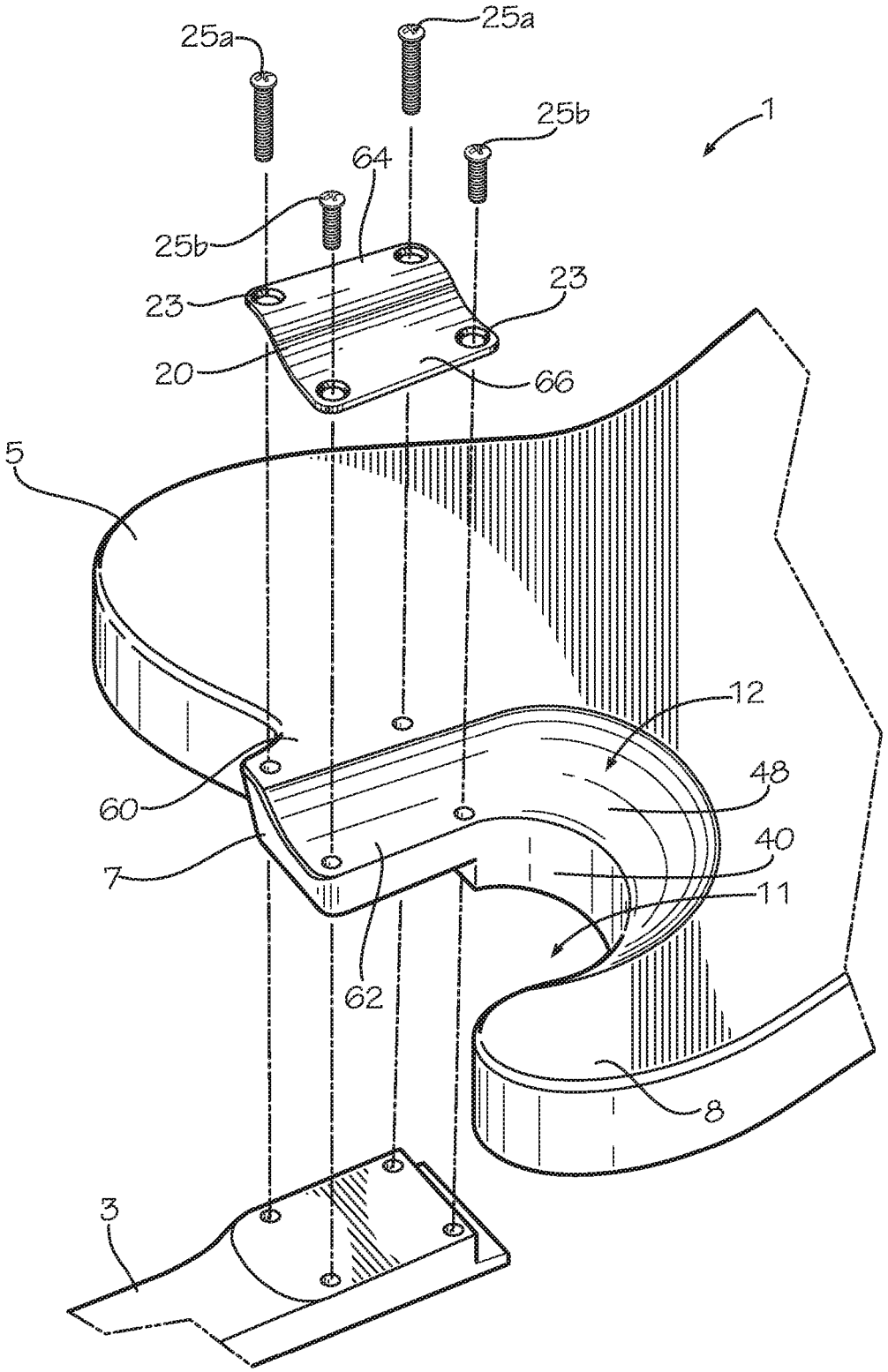
FIG. 10 is an exploded view of another embodiment of a stringed instrument of the present invention having bolts with varying lengths.

In some embodiments as shown in FIG. 9, all of the bolts 25 can have the same length. In other embodiments, as shown in FIG. 10, first bolts 25*a* can be longer than second bolts 25*b*. The bolts 25 may differ in length depending on the thickness of the body 5 at a location where the bolts 25 are inserted into the body 5. Since the second bolts 25*b* extend through cutout surface 48 of cutout 12 where the thickness of the top head portion 7 is reduced, second bolts 25*b* can be shorter such that second bolts 25*b* do not extend through neck 3 and can generally extend to the same position along the thickness of the body 5 as first bolts 25*a*. While the embodiment shown in FIG. 9 includes four bolts 25 and corresponding through holes 23 in the neck plate 20, the location and number of through holes 23 and corresponding bolts 25 provided in the neck plate 20 can vary in different embodiments.

Those of ordinary skill in the art will appreciate that the presently-disclosed stringed instrument 1 can provide numerous advantages and solve many long-felt but unmet needs. Because the instrument 1 includes a cutout 12 as well as a neck plate 20 to help secure the neck 3 to the body 5 of the instrument 1, the instrument 1 can provide easier access to the upper register of the neck 3 while also maintaining the structural, acoustic, and visual qualities of a conventional neck plate. Additionally, the instrument 1 can include a cutout that extends into an area of the top head portion 7 of the body 5 that would otherwise be covered by a neck plate. By incorporating a neck plate 20 that contacts and contours a surface of a cutout 12, the presently-disclosed instruments can provide the combined benefits of a neck plate 20 and a cutout 12. In conventional stringed instruments, when a cutout is used, either no plate is incorporated into the instrument or the size of the neck plate is substantially reduced which can affect the sound of the instrument, as well as the structural integrity of the connection between the neck and the body of the instrument. The neck plate 20 shown in FIGS. 2-6 in some embodiments can span substantially the entire width of the top head portion 7 of the body 5 while being shaped to contour the cutout 12 defined in the body 5 of the instrument 1.

The shape of the neck plate 20 can vary according to the cross-section of the cutout 12 in the body 5. In some embodiments, the cutout 12 can have a substantially curved S-shaped cross-section and can include a first curve 44 and a second curve 46, the first and second curves 44 and 46 curving in opposing directions to form a generally S-shaped cross-section. In FIG. 3, the second curve 46 is positioned more proximate to the cutaway edge 40 than the first curve 44. As such, the neck plate 20 can have a corresponding generally S-shaped cross section that can contour the cross-section of the cutout 12. The S-shaped cross-section of the cutout 12 and corresponding neck plate 20 can allow the heel of user's fretting hand to be received comfortable in the cutout 12 as a user frets the higher register of the neck 3.

Figure 6:
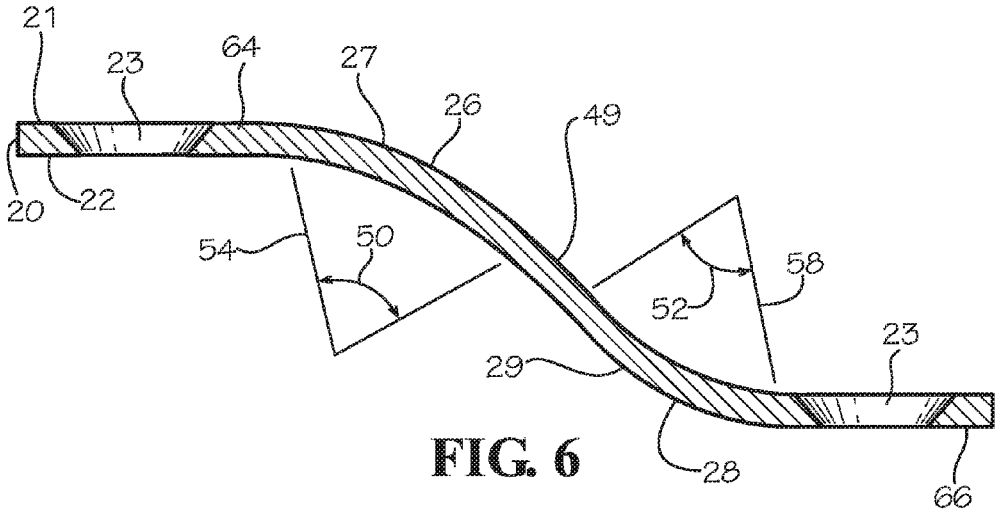
FIG. 6 is a cross-sectional view of the neck plate of FIG. 5.

FIGS. 5 and 6 show isometric and cross sectional views of the neck plate 20 of FIGS. 3-4, respectively. The neck plate 20 includes a top side 21 and a bottom side 22. The top side 21 is exposed when the neck plate 20 is mounted to the instrument 1, whereas the bottom side 22 faces towards the body 5 when the neck plate 20 is mounted to the instrument 1. The neck plate 20 includes a cross sectional contour that includes a first bend 26 having a first curvature 27 and a second bend 28 having a second curvature 29. The concavities of the first and second curvatures 27 and 29 of the neck plate 20 can be oriented in opposing directions such that an inflection point 49 is formed between the first and second bends 26 and 28 where the direction of the curvature of the neck plate 20 changes.

Referring now to FIGS. 3, 5, and 6, the cross-sectional contour of the neck plate 20 can correspond to the cross-sectional contour of the cutout 12, with the first curvature 27 of the neck plate 20 corresponding with the first curve 44 of the cutout 12, and the second curvature 29 of the neck plate 20 corresponding to the second curve 46 of the cutout 12. When the instrument 1 is assembled with the neck plate 20 positioned on the back side of the top head portion 7 of the body 5, the bottom side surface 22 of the neck plate 20 contacts the back surface 32 of the body 5 and a portion of the cutout surface 48 of the cutout 12 located proximate the top head portion 7 of the body 5. In some embodiments, the entire bottom side surface 22 of the neck plate 20 can make contact with the body 5. The plate 20 can include a back surface portion 70 disposed against the back surface 32 of the body 5 proximate the top head portion 7, and a cutout portion 72 disposed against the cutout surface 48 of the cutout 12. When the neck plate 20, the body 5, and neck 3 are coupled together, the neck plate 20 can help distribute coupling forces applied by the bolts 25 to the body 5 across a larger surface area to help decrease damage to the body 5 from the bolts 25 and increase structural strength of the connection between the neck 3 and the body 5.

The first curvature 27 and the second curvature 29 can vary depending on the contour of the corresponding cutout 12. In some embodiments, the contour of the cutout 12 can be shaped such that the angle of the first and second bends 44 and 46, and therefore the angles 50 and 52 of corresponding first and second curvatures 27 and 29 of the neck plate 20, respectively, can be between about 0 and 90 degrees. In some embodiments, angles 50 and 52 of first and second curvatures 27 and 29 can each independently be about 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, 85 degrees, or 90 degrees.

In some embodiments, the contour of the cutout 12 can be shaped such that the radius of the first and second bends 44 and 46, and therefore the radii 54 and 58 the first and second curvatures, 27 and 29, respectively, can each independently be about 0.1 inches, 0.2 inches, 0.3 inches, 0.4 inches, 0.5 inches, 0.6 inches, 0.7 inches, 0.8 inches, 0.9 inches, 1.0 inches, 1.1 inches, 1.2 inches, 1.3 inches, 1.4 inches, 1.5 inches, 1.6 inches, 1.7 inches, 1.8 inches, 1.9 inches, 2.0 inches, or more.

In some embodiments the radius 54 of the first curvature 27 and the radius 58 of the second curvature 29 can be substantially equal such that the S-shape of the cross-section of the neck plate 20 can be substantially symmetrical about inflection point 49. In other embodiments, the radius 54 of the first curvature 27 and the radius 58 of the second curvature 29 can be different such that the cross-section of the neck plate 20 is not symmetrical about the inflection point 49. In other embodiments, the radius 54 of the first curvature 27 can be greater than the radius 58 of the second curvature 29.

Figure 7:
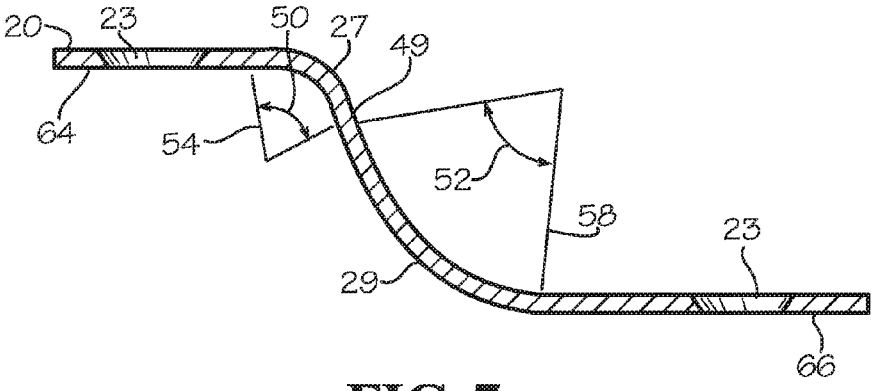
FIG. 7 is a cross-sectional view of another embodiment of a neck plate of the present disclosure having a first curvature and a second curvature with different dimensions.
Figure 8:
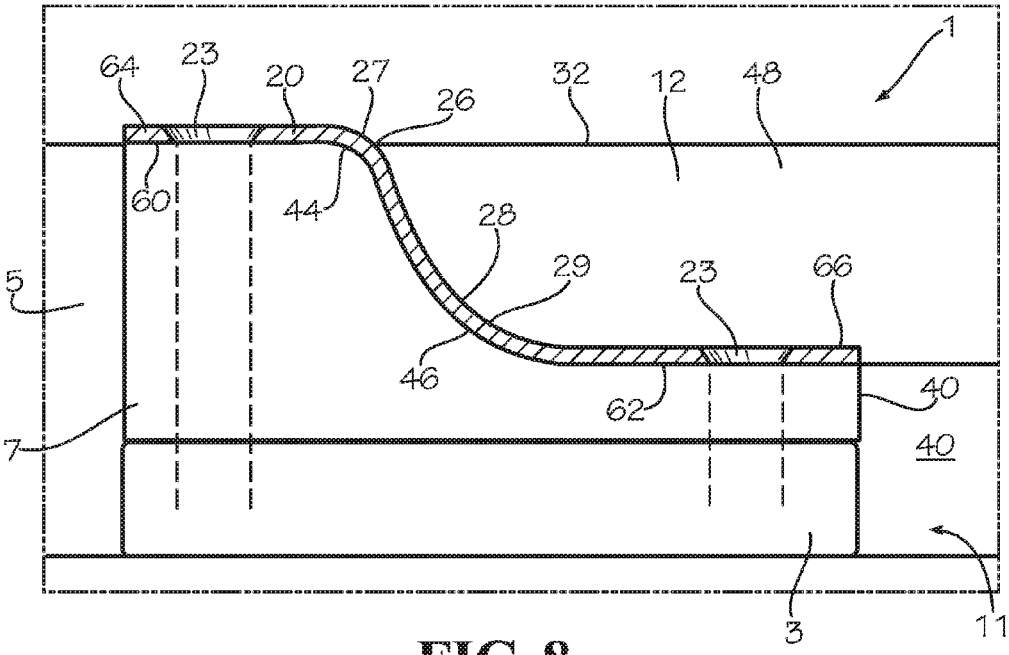
FIG. 8 is a detailed top view of a stringed instrument including the neck plate of FIG. 7 positioned on a body of a corresponding stringed instrument.

In other embodiments, as shown in FIGS. 7-8, the contour of the cross-section of the cutaway 12 can be such that the radius 54 of the first curvature 27 can be less than the radius 58 of the second curvature 29. Such a configuration can produce a deeper cut into the width of the body 5 of the instrument 11, and particularly the width of the top head portion 7 of the body 5, to help increase access to the higher register of the stringed instrument 1 by the user.

In some embodiments, a back surface 32 of the body 5 can be substantially flat, or the back surface 32 proximate the top head portion 7 can include a substantially flat body surface 60 positioned proximate the cutout 12, and the cutout 12 can include a substantially flat cutout surface 62 positioned proximate the cutaway edge 40. In some embodiments the first curvature 27 and the second curvature 29 of the neck plate 20 can have substantially the same angles 50 and 52 so that portions at opposite ends of the neck plate 20 are substantially parallel. In some embodiments, the neck plate 20 can include a first flat plate portion 64 and a second flat plate portion 66 at opposing ends of the neck plate 20. When the neck plate 20 is positioned on the body 5, the first flat plate portion 64 can be disposed against the flat body surface 60 on the back surface 32 of the top head portion 7 of the body 5, and the second flat plate portion 66 can be disposed against the flat cutout surface 62 of the cutout 12. In this manner, bolts 25 used to mount the neck plate 20, the neck 3 and the body 5 together can be oriented substantially perpendicular to the surface of the body 5 and to the cutout 12, and the bolts 25 can extend into the neck 3 generally at a 90 degree angle with a surface of the neck 3 positioned against the top head portion 7 of the body 5.

Embodiments having bolts 25 that are perpendicular to the surface of the body 5, the cutout 12, and the surface of the neck positioned against the body 5 can help minimize stress and/or strain on the body 5 and neck 3 of the instrument 1 as the body 5 and the neck 3 are secured or coupled together via bolts 25. In other embodiments the angles of the first curvature 27 and the second curvature 29 may be different from one another as necessary in order to permit the bolts to be mounted perpendicular to the back surface 32 of the body 5 and the cutaway surface 48. In still further embodiments, the through holes 23 in the neck plate 20 can be oriented at an angle with respect to a top side 21 of the neck plate 20 as necessary for the bolts 25 to extend through the neck plate 20 and the body 5 at an angle that is perpendicular with the surface of neck 3 positioned against the body 5.

As the depth of the cutout 12 increases, the volume that is removed from the back surface 32 of the body 5 increases. In some instances, the depth of a cutout 12 on an instrument 1 can be increased by creating a cutout 12 and a corresponding neck plate 20 that includes a second curvature 29 having a greater radius 58 than a radius 54 of the first curvature 27. The second curvature 29 can provide a deeper cut into the width of the top head portion 7 of the body 5. Furthermore, the width of the flat cutout surface 62 of the cutout 12 can be increased without increasing the radius 58 of the second curvature 29 to provide a deeper cut into the width of the top head portion 7 of the body 5. Increasing the flat contact area between the neck plate 20 and a flat cutout surface 62 can further minimize stress and strain when the neck plate 20, the body 5, and the neck 3 are mounted together.

Those of ordinary skill will appreciate that the cross sectional contour of cutouts described herein, including cutout configured for use with neck plates including a second curvature that has a greater radius than a radius of the first curvature, present numerous benefits. Among other things, such cutouts may provide increased access to the upper register relative to other cutouts that are not as deep. Accordingly, the cutouts described herein can also be advantageous for stringed instruments that do not include a neck plate, for instance those instruments where the neck and body of the instrument are secured together with bolts, screws or other fasteners without the use of a neck plate, or where the neck and the body are glued together or formed together as one integral structure.

While an embodiment of an instrument has been described for illustrative purposes, other embodiments encompassed by the presently-disclosed instrument should not be limited by the present embodiment. Those of skill in the art will appreciate that other shapes, sizes, and contours of neck plates and cutouts can be utilized to provide increased access to the upper register of the neck 3 and the benefits of a neck plate 20. Such configurations may vary depending on the aesthetic or acoustic preferences of a musician, the type of instrument, the shape and size of the body, the size of the user's hands, or the like.

For instance, in some embodiments, the cutout 12 and corresponding neck plate 20 can include a single bend or curvature, and the cutout 12 and neck plate 20 in other embodiments can include three or more different bends or curvatures. In still other embodiments, the cutout 12 can have a substantially rectangular shape, and the corresponding neck plate 20 can have a substantially square S-shape where the bends in the neck plate 20 are square 90 degree bends. In other embodiments, the cutout 12 can have a trapezoidal cross section, wherein the corresponding neck plate 20 includes two sharp bends having acute or obtuse angles and an angled flat portion extending between the two bends and between opposing parallel flat end portions of the neck plate 20. One of skill in the art will readily appreciate that the cutout 12 and corresponding neck plate 20 can be designed to include various combinations and numbers of curved and/or sharp bends, with the neck plate 20 still having a shape or cross-section that corresponds to or contours a cross section of the cutout 12 to provide the combined benefits of a cutout 12 and a neck plate 20.

The embodiments shown in FIGS. 2-10 include a neck plate 20 that has a substantially rectangular top profile, but the shape and size of the neck plate 20 can be modified in other embodiments. In some instances the shape of a neck plate 20 can be modified to permit different shapes and contours of cutouts. In some embodiments the neck plate 20 includes a substantially triangular or trapezoidal top profile, wherein a portion of the neck plate corresponding to the top, treble-side corner of the neck plate is removed. In other embodiments, a portion of the neck plate corresponding to the top, bass-side corner of the neck plate 20 is removed. In some embodiments, such triangular neck plates can permit even deeper cutouts to be made at the top head portion 7 of the body. In other embodiments, triangular neck plates can permit the cutaway to extend further into the top, treble-side corner of the top head portion 7 of the body 5.

Figure 11:
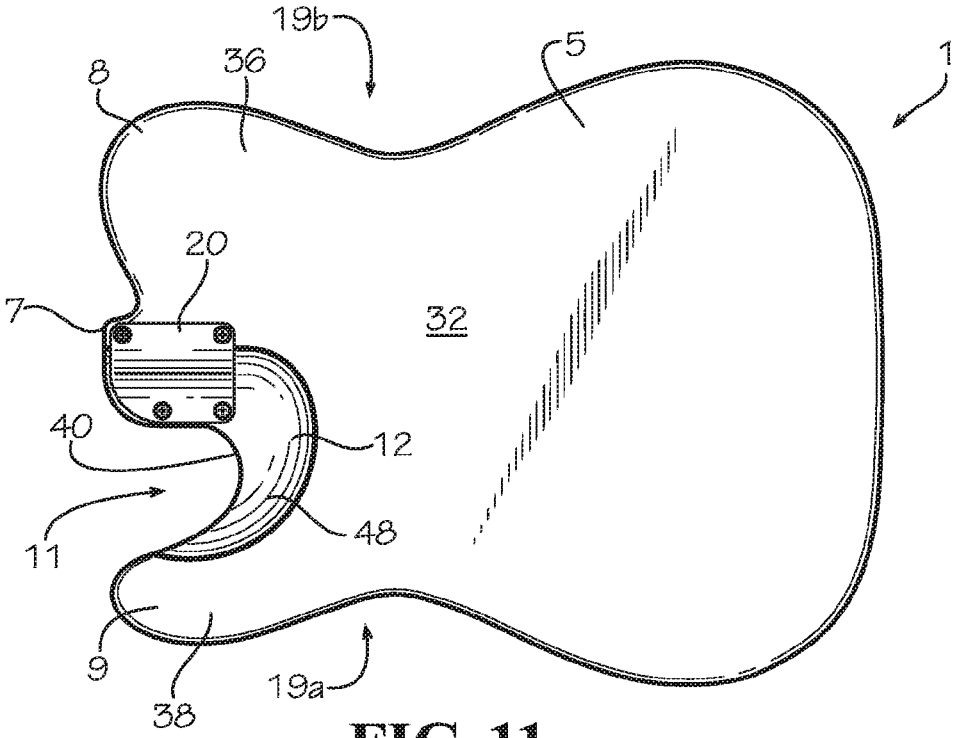
FIG. 11 is a detailed view of another embodiment of a stringed instrument where a top treble-side corner of a top head portion of a body of the stringed instrument and a corresponding top treble-side corner of the neck plate are curved or rounded.
Figure 12:
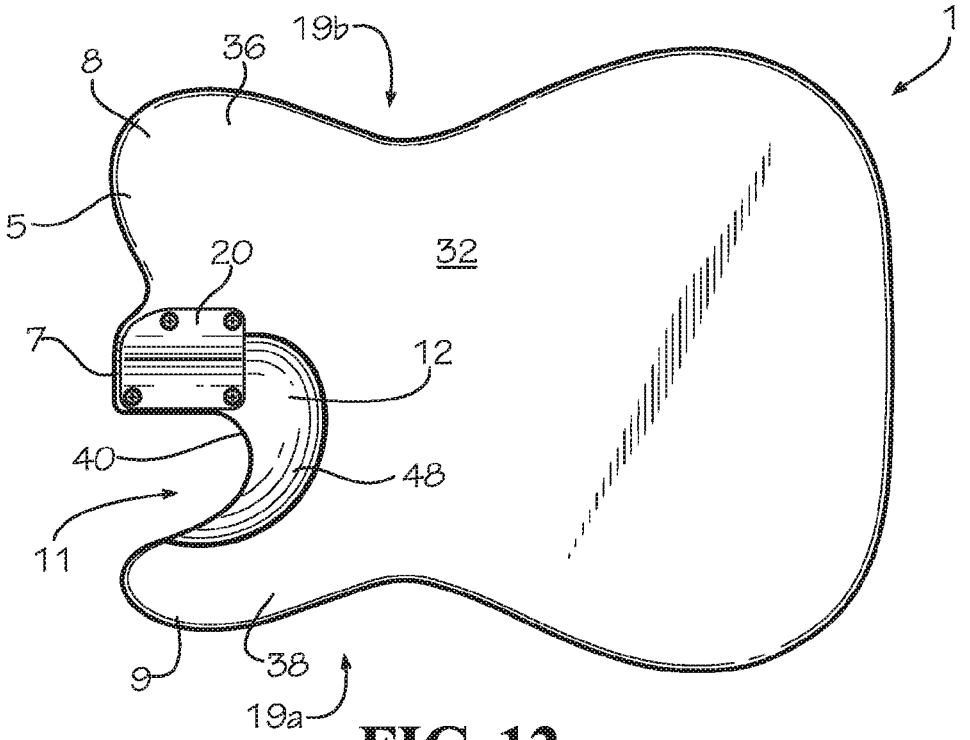
FIG. 12 is a detailed view of another embodiment of a stringed instrument where a top bass-side corner of a top head portion of a body of the stringed instrument and a corresponding top bass-side corner of the neck plate are curved or rounded.

Additional, exemplary neck plate configurations are shown in FIGS. 11 and 12. In FIG. 11, a top treble-side corner of the top head portion 7 of the body 5 and a top treble-side corner of the neck plate 20 can have corresponding rounded or curved top profiles. In FIG. 12, a top bass-side corner of the top head portion 7 of the body 5 and a top bass-side corner of the neck plate 20 can have corresponding rounded or curved top profiles. Rounded corners on the top head portion 7 of the body 5 and the plate 20 can provide another aesthetic and/or acoustic profile to the instrument 1.

The features described herein can be used in a variety of stringed instruments that are employed by those of ordinary skill in the art. This includes, without limitation, guitars, basses, violins, cellos, fiddles, banjos, mandolins, and the like. The features described herein can also be utilized for instruments having multiple necks connected to the body at corresponding top head portions, with a cutaway, cutout, and neck plate as taught herein provided for each neck of the stringed instrument. Also, while the embodied stringed instruments described herein are configured for right-handed musicians, the present stringed instruments and their novel components can be configured for left-handed or right-handed musicians.

The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

The presently-disclosed subject matter can comprise, consist of, or consist essentially of the elements and features of the embodiments described herein, as well as any additional or optional components or limitations described herein or which are otherwise useful.

All combinations of method or process steps as used herein can be performed in any order, unless otherwise specified or clearly implied to the contrary by the context in which the referenced combination is made.

Thus, although there have been described particular embodiments of the present invention of a new and useful STRINGED INSTRUMENT, it is not intended that such references be construed as limitations upon the scope of this invention.

What is claimed is:

1. An instrument, comprising:

a body that includes a back surface, a top head portion, and a treble-side;

a cutaway defined in the body adjacent the top head portion on the treble-side of the body, the cutaway defining a cutaway edge;

a cutout defined in the back surface of the body, the cutout extending from the top head portion of the body along at least a portion of the cutaway edge, the cutout defining a cutout surface;

a neck extending from the body, a portion of the neck disposed on a front side of the top head portion of the body; and a neck plate disposed on a back side of the top head portion of the body, at least a portion of the neck plate positioned on the cutout surface;

wherein the neck plate includes a plate cross section that corresponds to a cross section of the cutout at a location proximate the top head portion of the body.

2. The instrument of claim 1, further comprising a plurality of bolts, the plurality of bolts extending through the neck plate and the body and into the neck to separably couple the neck plate, the body, and the neck together.

3. The instrument of claim 2, wherein:

the cutout defines a cutout surface;

the plurality of bolts includes at least a first bolt and a second bolt;

the first bolt extends through the back surface of the body at a location proximate the cutout; and the second bolt extends through the cutout surface of the cutout.

4. The instrument of claim 3, wherein the first bolt is longer than the second bolt.

5. The instrument of claim 1, wherein the neck plate includes a first bend having a first curvature and a second bend having a second curvature.

6. The instrument of claim 5, wherein a radius of the first curvature is smaller than a radius of the second curvature.

7. The instrument of claim 5, wherein a radius of the first curvature is substantially equal to a radius of the second curvature.

8. The instrument of claim 5, wherein the concavities of the first and second curvatures in the neck plate are oriented in opposing directions.

9. The instrument of claim 1, wherein:

the back side of the top head portion of the body includes a flat body surface positioned proximate the cutout; and the cutout includes a flat cutout surface positioned proximate the cutaway edge.

10. The instrument of claim 9, wherein:

the neck plate includes a first flat plate portion and a second flat plate portion;

the first flat plate portion is disposed against the first flat body surface of the back side of the top head portion of the body; and the second flat plate portion is disposed against the flat cutout surface of the cutout.

11. The instrument of claim 1, wherein the body includes a thickness and the cutout only extends through a portion of the thickness of the body.

12. The instrument of claim 1, wherein the cutaway has a generally semi-circular shape.

13. The instrument of claim 1, wherein the neck plate has a width substantially equal to a width of the top head portion of the body.

14. An instrument, comprising:

a body that includes a back surface, a top head portion, and a treble-side horn;

a recessed cutaway defined in the body between the top head portion and the treble-side horn, the recessed cutaway defining a cutaway edge extending from the top head portion of the body to the treble-side horn;

a cutout defined in the back surface of the body, the cutout extending from the top head portion of the body along at least a portion of the cutaway edge, the cutout defining a cutout surface;

a neck extending from the body, a portion of the neck disposed on a front side of the top head portion of the body; and a neck plate disposed on a back side of the top head portion of the body, at least a portion of the neck plate positioned on the cutout surface;

wherein the portion of the neck plate positioned in the cutout is shaped to contour the cutout.

15. The instrument of claim 14, wherein:

the neck plate includes a back surface portion and a cutout portion;

the back surface portion is disposed against the back side of the top head portion; and the cutout portion is disposed against the cutout.

16. The instrument of claim 14, wherein the neck plate has a first bend having a first curvature, a second bend having a second curvature, and an inflexion point positioned between the first and second bends.

17. An instrument, comprising:

a body that includes a back surface, a top head portion, and a treble-side horn;

a recessed cutaway defined in the body between the top head portion and the treble-side horn, the recessed cutaway defining a cutaway edge extending from the top head portion of the body to the treble-side horn;

a cutout defined in the back surface of the body, the cutout extending from the top head portion of the body along at least a portion of the cutaway edge, the cutout defining a cutout surface;

a neck extending from the body, a portion of the neck disposed on a front side of the top head portion of the body;

a neck plate disposed on a back side of the top head portion of the body, at least a portion of the neck plate positioned on the cutout surface; and a plurality of bolts extending through the neck plate and the body and into the neck to separably couple the neck plate, the body, and the neck together;

wherein at least one of the plurality of bolts extends through the cutout surface of the cutout.

18. The instrument of claim 17, wherein the neck plate further comprises a first bend and a second bend, the first and second bends oriented in opposite directions.

19. The instrument of claim 17, wherein the neck plate is a generally S-shaped plate.

20. The instrument of claim 17, wherein the cutout converges as the cutout extends toward the treble-side horn on the body.

* * * * *